US006776015B2

(12) United States Patent
Seagar et al.

(10) Patent No.: US 6,776,015 B2
(45) Date of Patent: Aug. 17, 2004

(54) PERFORATION OF LAUNDRY MACHINE DRUM

(75) Inventors: Neville David Seagar, Auckland (NZ); Alex David Salisbury, Auckland (NZ)

(73) Assignee: Fisher & Paykel Limited, Auckland (NZ)

( * ) Notice: Subject to any disclaimer, the term of this patent is extended or adjusted under 35 U.S.C. 154(b) by 26 days.

(21) Appl. No.: 09/904,287

(22) Filed: Jul. 12, 2001

(65) Prior Publication Data

US 2002/0023467 A1 Feb. 28, 2002

(30) Foreign Application Priority Data

Jul. 13, 2000 (NZ) ..... 505748

(51) Int. Cl.[7] ..... D06F 37/04
(52) U.S. Cl. ..... 68/24; 68/58; 68/142
(58) Field of Search ..... 68/23 R, 142, 68/143, 24, 58, 139, 146; 366/234, 237

(56) References Cited

U.S. PATENT DOCUMENTS 120,717 A * 11/1871 Colvin
175,184 A * 3/1876 Smith
244,198 A * 7/1881 De Voe
382,149 A * 5/1888 Fowles
450,675 A * 4/1891 Montfort
523,343 A * 7/1894 Haberacker
1,502,872 A * 7/1924 Oberg
1,505,881 A * 8/1924 Fisher

FOREIGN PATENT DOCUMENTS

DE 3913736 * 10/1990

* cited by examiner

*Primary Examiner*—Frankie L. Stinson
(74) *Attorney, Agent, or Firm*—Trexler, Bushnell, Giangiorgi, Blackstone & Marr, Ltd.

(57) ABSTRACT

A laundry machine drum has a sheet material skin including an arrangement of a plurality of perforations therethrough. Each of one or more of the perforations includes a shear cut in the sheet material. The sheet is deformed in the region of the shear cut such that the edge of the sheet material of one side of the shear cut is offset from the edge of the sheet material of the other side of the shear cut over at least some of the length of the shear cut. An opening is formed between the offset edges. The apparent area of the opening is greater when viewed from at least one direction substantially parallel to the general plane of the drum skin in the region of the perforation than when viewed from a direction substantially perpendicular to the general plane of the drum skin in the region of the perforation.

10 Claims, 3 Drawing Sheets

PERFORATION OF LAUNDRY MACHINE DRUM

BACKGROUND TO THE INVENTION

1. Field of the Invention

The present invention relates to laundry machine drums and in particular to the form of perforations in the laundry machine drum skin and to methods of forming same.

2. Summary of the Prior Art

In laundry machines, of both horizontal and vertical axis varieties, it is well known to provide a drum having a metal, for example stainless steel, drum skin. In general this drum skin is provided with an arrangement of a plurality of openings therethrough. These openings are for example plain holes through the drum skin which may be formed by punching or by lancing from the inside surface of the skin.

In a washing or rinsing operation wash liquids may pass through the drum skin in one or other direction. In a dehydration operation wash liquids are extracted from a saturated clothes load retained within the drum by centrifugal force when the drum is spun at high speeds.

It is known in the prior art that burrs on the outermost edge of the sheet metal at the holes are dangerous to the fingertips of a user of a laundry machine and/or to laundry. The burrs may catch laundry fibres which may pass outwardly through the holes and become caught.

Furthermore it has been found that there is a limitation on maximum drum spinning speeds that can be safely used where a plain hole perforation is adopted. Where the spinning speed reaches above a certain level and the centrifugal forces become too great, either the laundry fabrics are drawn outwardly through the plain holes or the fabric spanning the plain hole tears outwardly at its centre under the forces exerted. If the laundry extrudes outwardly through He holes it may be tom when removing the laundry from the surface of the drum even though burrs may not be present at the outer edges of the plain holes.

SUMMARY OF THE INVENTION

It is accordingly an object of the invention to provide a laundry drum for a washing machine incorporating perforations which will at least go some way towards overcoming the above disadvantages and/or to provide a method of forming such perforations.

In a first aspect the invention consists in a laundry machine drum having a sheet material skin including an arrangement of a plurality of perforations therethrough, each of one or more of said perforations including:

a shear cut in said sheet material, the sheet being deformed in the region of said shear cut such that the edge of the sheet material of one side of said shear cut is offset from the edge of the sheet material of the other side of said shear cut over at least some of the length of said shear cut such that an opening is formed between said offset edges and the apparent area of said opening is greater when viewed from at least one direction substantially parallel to the general plane of said drum skin in the region of said perforation than when viewed from a direction substantially perpendicular to tie general plane of said drum skin in said region of said perforation.

In a further aspect the invention consists in a method of forming a perforation in a laundry machine comprising operating on a sheet material with a punch and corresponding die, said punch having a leading face, and a shearing edge defining one edge of said leading face, said die having a leading face and a complementary shearing edge to said punch shearing edge, said leading faces and shearing edges of said punch and said die formed such that movement of said punch in an advance direction relative to said die causes said shearing edge of said punch to overlap with said shearing edge of said die at at least the middle of said shearing edges, and to overlap progressively less away from the middle of said shearing edges, to produce a sheared cut in a material placed there between which progressively reduces in displacement from its middle to its ends.

In still further aspect the invention may broadly be said to consist in a laundry machine drum having a sheet material skin including an arrangement of a plurality of perforations therethrough, each of one or more of said perforations being formed in accordance with a method as set forth above.

In a still farther aspect the invention may broadly be said to consist in a laundry machine drum having a sheet material skin including an arrangement of a plurality of openings therethrough, at least one said opening having a form such that the apparent area of said opening is greater when viewed from at least one direction substantially parallel to the general plane of said drum skin in the region of said perforation than when viewed from a direction substantially perpendicular to the general plane of said drum skin in said region of said perforation.

To those skilled in the art to which the invention relates, many changes in construction and widely differing embodiments and applications of the invention will suggest themselves without departing from the scope of the invention as defined in the appended claims, The disclosures and the descriptions herein are purely illustrative and are not intended to be in any sense limiting.

BRIEF DESCRIPTION OF TEE DRAWINGS

DETAILED DESCRIPTION

The present invention relates to a new form of perforation for the skin of a laundry machine drum. This drum may be of a washing machine of horizontal or vertical axis or could for example be of a clothes dryer. Typically the drum skin will have a geometrical array or pattern of openings or perforations over the area thereof. All of the openings may be of the form according to the present invention or alternatively only a proportion may have such form. For example it is considered that perforations or openings in the drum end may remain plain holes, the surfaces of the drum ends for example being at least substantially parallel to the centrifugal force generated in a dehydrational spin operation.

Referring then to the form of perforation according to the preferred embodiment of the present invention this is illustrated in FIGS. 1, 2, 6 and 7.

Figure 1:
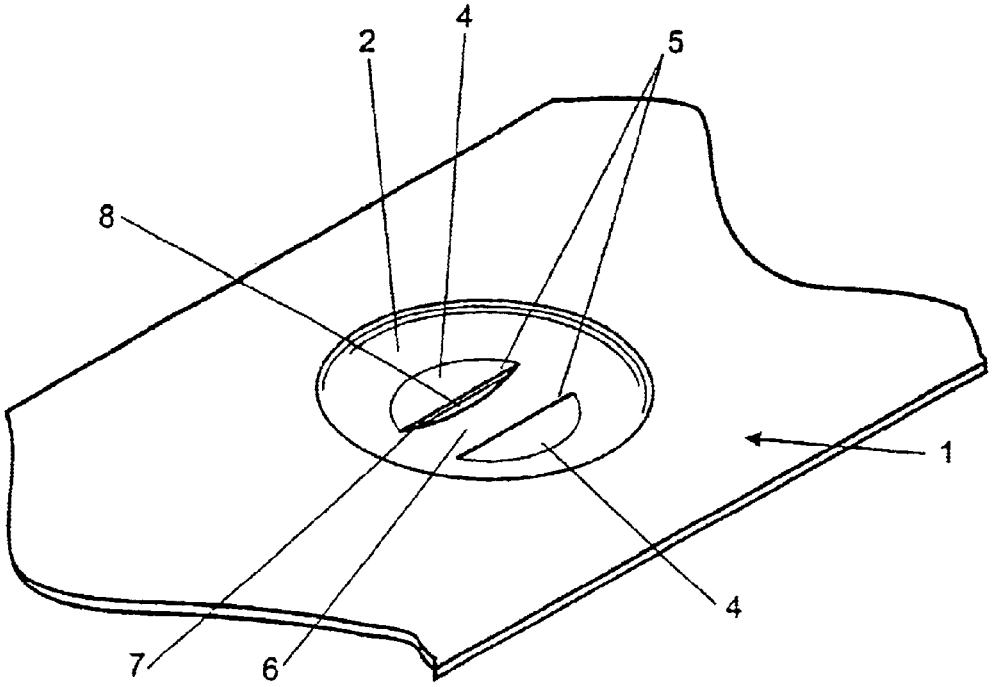
FIG. 1 is a perspective view of a small portion of a drum skin including a perforation according to a preferred embodiment of the present invention when viewed from inside the drum.
Figure 2:
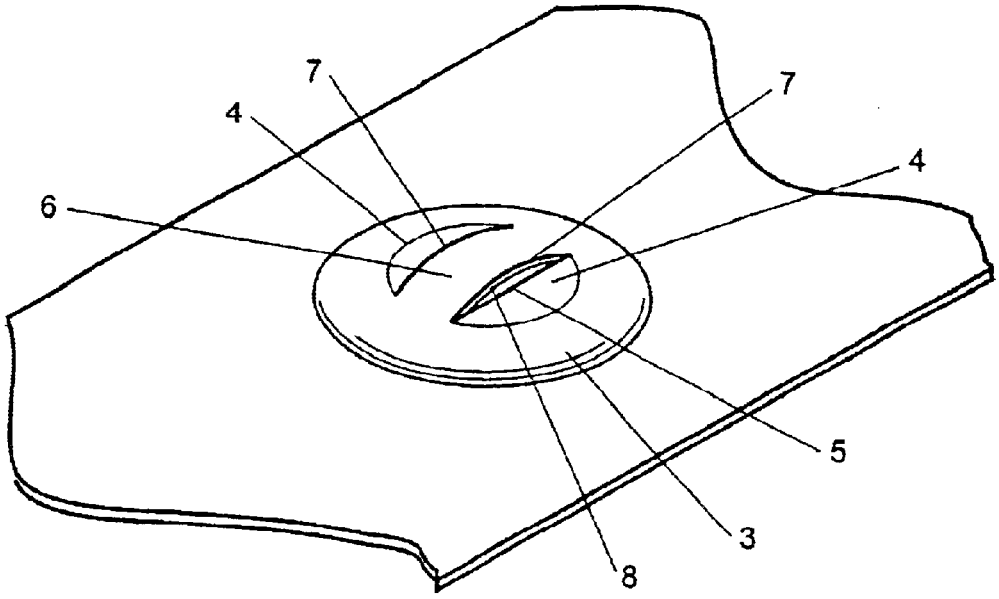
FIG. 2 is a perspective view of a small portion of a drum skin including a perforation according to a preferred embodiment of the present invention when viewed from outside the drum.

Referring to FIG. 1 a section of drum skin 1 is shown. A circular semi spherical depression 2 is apparent on the inner surface of the drum skin 1. The semi spherical depression 2 accordingly corresponds with a dimple or dome shape 3 apparent on the outer surface in FIG. 2. The depression 2 is not semi spherical to its full depth. At a partial depth thereof a pair of flat surfaces 4 intrude the semi spherical depression and are substantially parallel in orientation with the general plane of the drum skin 1 in the region of the perforation. These surfaces end at edges 5 Edges 5 are parallel and spaced apart. For reasons which will become apparent when the forming method is described the edges 5 may be referred to as shear edges. A bridge 6 of material continues the hemispherical shape of the hemispherical depression 2. Bridge 6 is bounded at the sides thereof by shear edges 7. The shapes thus defined leave a pair of openings 8, one at each side of the bridge 6, each of whose perimeter is defined by a shear edge 7 of the bridge 6 and a shear edge 5 of a flat 4.

It will be readily appreciated that variations on the proposed perforations are possible, and on the proposed tools for implementing same. For example it will be appreciated that it is not requisite that either or both of the shear cuts be a straight cut and that these cuts could instead be curved in the plane of the sheet. Thus for example where two such shear cuts are present and they are referred to as being parallel his means in a broad or overall context and is not to be read as being strictly limiting.

Figure 6:
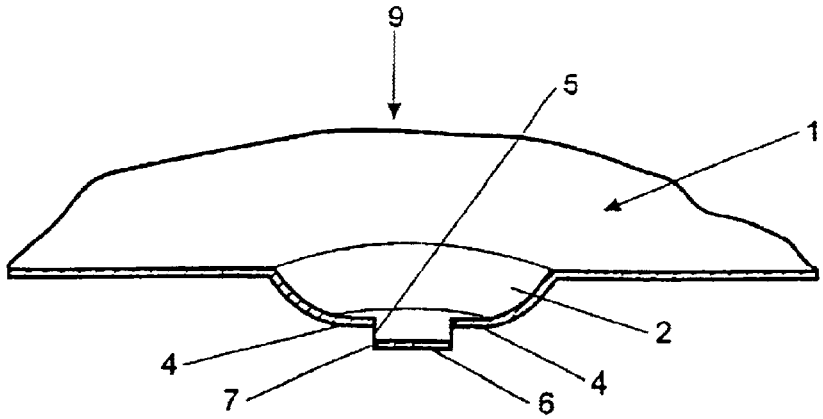
FIG. 6 is a cross sectional side elevation of a drum skin from a shallow angle with the cross section taken across the perforation according to the preferred form of the present invention.
Figure 7:
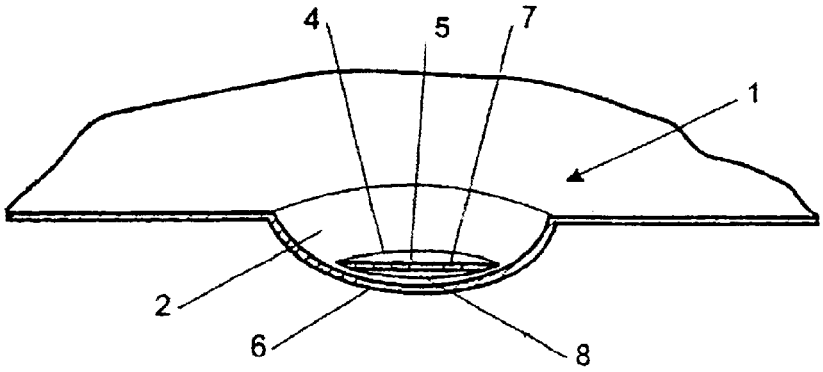
FIG. 7 is a cross sectional side elevation of a drum skin from a shallow angle with the cross section taken across the perforation according to the preferred form of the present invention from a direction perpendicular to the direction of FIG. 6.

As will be apparent from FIGS. 6 and 7 when viewed from a direction which is at least substantially perpendicular to the general plane of the sheet in the region of the perforation, for example a direction as indicated by arrow 9, the openings 8 have little or no apparent area. However when viewed from at least one direction, for example as indicated by arrow 10 substantially parallel with the general plane of the sheet in the region of the perforation the entire or maximum area of the openings 8 is visible. Such as the view of the openings 8 depicted more or less in FIG. 7.

Figure 3:
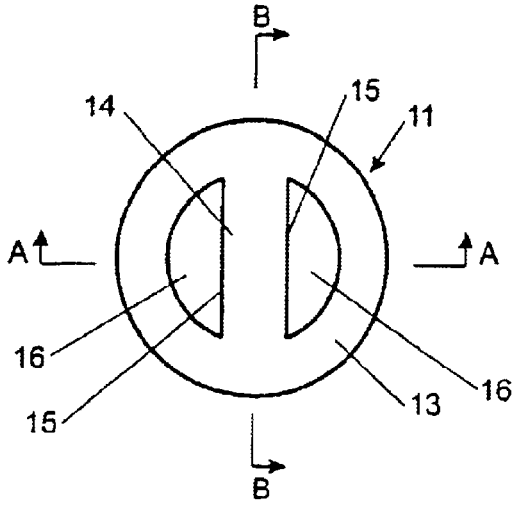
FIG. 3 is an end elevation of a punch for use in forming a drum perforation as in FIGS. 1 and 2.
Figure 4:
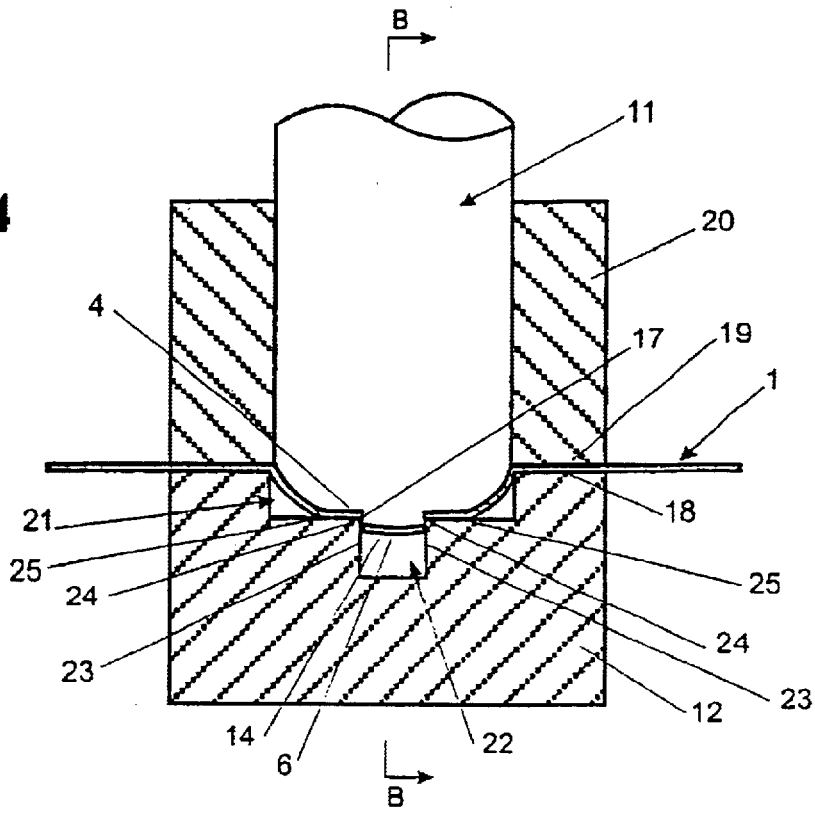
FIG. 4 is a cross sectional side elevation of a punch and die operating on a sheet material in forming a perforation according to FIGS. 1 and 2, said side elevation taken through plane AA in FIG. 3.
Figure 5:
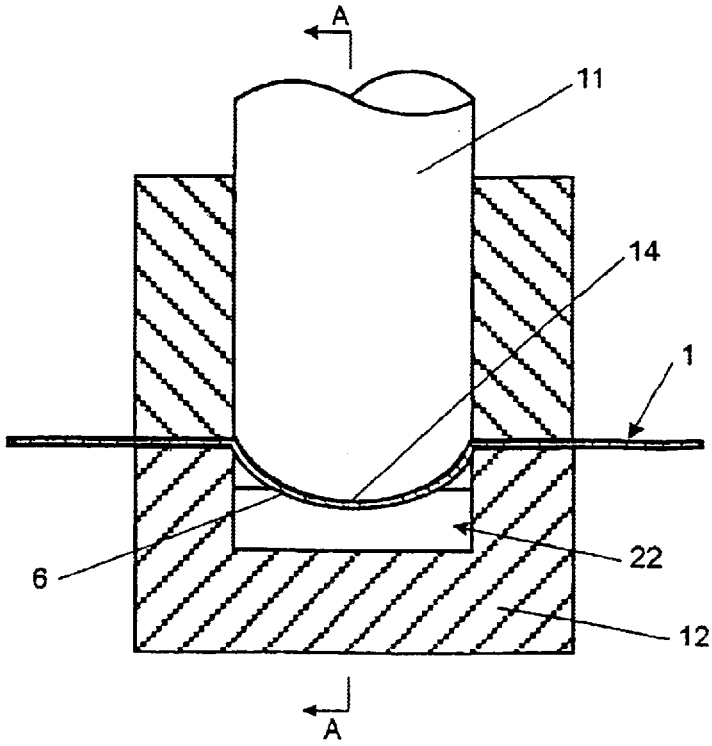
FIG. 5 is a cross sectional side elevation of a punch and die operating on a sheet material in forming a perforation according to FIGS. 1 and 2, said side elevation taken through plane BB in FIG. 3.

The forming process for a perforation in accordance with the present invention is illustrated with particular reference to FIGS. 3 to 5. In these Figures forming of the perforation according to the preferred embodiment of the present invention is depicted using a punch tool 11 and a cooperating die tool 12. An end elevation of he punch tool 11 is shown in FIG. 3. The punch tool 11 has a semi spherical end surface 13. The semi spherical end surface 13 spans the perimeter region of the punch tool end. It also spans a bridging region 14 defined between a pair of cutting or leading edges 15. Bridging portion 14 of semi spherical face 13 will be a leading face of the punch tool 11 in use, A pair of rebates or notches are formed in the semi spherical face 13, resulting in a pair of semi circular flat faces 16 which in use form trailing faces of the punch tool 1. The semi circular trailing faces 16 in use form the flat portions 4 of the formed perforation. The leading face 14 forms the bridge 6 of the perforation. A shear wall 17 substantially parallel with the intended direction of travel of the punch tool 11 and substantially perpendicular to both the leading face 14 and the semi circular faces 16, extends between the semi circular faces 16 and the leading face 14, meeting the leading face 14 at shear edges 15. It will be readily appreciated that these shear walls are themselves semi circular in form.

Referring then to FIGS. 4 and 5 the punch tool 11 cooperates in use with a die 12. A sheet 1 to be formed is clamped between a periphery face 18 of the die 12 and a clamping face 19 of an annular clamping block 20 through which the punch tool 11 passes in use. The clamping between the clamping tool 20 and the die 12 secures the sheet 1 in position.

The die 12 has a circular rebate 21 to a depth which substantially complements the depth of the annular semi spherical periphery region of surface 13 of the punch tool 11. A channel 22 is further formed spanning across this circular rebate 21 and the base thereof The channel 22 is of substantially the same width, although slightly greater to tolerance, as the leading face 14 of the punch tool 11. It is of cooperating form, such that the edges 24 formed between the side walls 23 of the channel 22 and the bottom face 25 of the circular rebate 21 cooperate with the shear edges 15 of the punch tool 11 in a shearing action to shear a sheet 1 of material upon movement of the punch tool 11 fully into the die cavity until the trailing faces 16 of the tool and the bottom faces or anvil faces 25 of the circular rebate 21 come together with the flat faces 4 of the sheet 1 therebetween. This shearing action between the shearing edge 24 of the die 12 and the shearing edge 15 of the punch 11 and subsequent deformation of the bridge portion 6 of the sheet 1 beyond the position of the flat faces 4 forms openings 8.

A number of variations on the invention will be apparent. For example the perforation may incorporate only a single shear cut rather than a pair of opposing myriad shear cuts. This would however have the disadvantage of unbalanced side loading on the punch tool 11 in the punching process. In addition it will be appreciated that the hemispherical depression is not a necessary part of the perforation, and that an arching bridge or trapezoidal bridge might be pushed from the plane of the sheet without deforming the sheet in the general area of such a bridge.

It will also be appreciated that perforations maybe formed by an alternative process which have the same essential characteristic of apparent area from a direction perpendicular to the sheet being less than the apparent area from a direction parallel to the sheet. For example such a perforation might possibly be formed by lancing a hole through the drum skin and subsequently rotating the axis of the lance to a direction substantially parallel with the skin prior to withdrawal. Adaptations of such a process to further incorporate a die or similar cooperating surface on the opposed side of the sheet might also be envisaged. While this is not considered a preferred method of forming, a perforation thus formed does not depart from the scope of the invention in its broadest sense.

What is claimed is:

1. A laundry machine drum having a sheet material skin including an arrangement of a plurality of perforations therethrough, each of one or more of said perforations including:

a shear cut in said sheet material, the sheet being deformed in the region of said shear cut such that the edge of the sheet material of one side of said shear cut is offset from the edge of the sheet material of the other side of said shear cut over at least some of the length of said shear cut such that an opening is formed between said offset edges and the apparent area of said opening is greater when viewed from at least one direction substantially parallel to the general plane of said drum skin in the region of said perforation than when viewed from a direction substantially perpendicular to the general plane of said drum skin in said region of said perforation.

2. A laundry machine drum as claimed in claim 1 wherein said deformed sheet material the material of one said side of said shear cut is displaced outward from the material of the other side of said shear cut relative to the intended spin axis of said drum, but the planar orientation of said regions immediately adjacent the edges of said regions at said shear cut are parallel to one another.

3. A laundry machine drum as claimed in claim 2 wherein said drum includes at least one group of two or more said perforations, said group defined by their proximity to one another, said openings of said group of perforations acing a common centre.

4. A laundry machine drum as claimed in claim 1 wherein said drum includes at least one group of two or more said perforations, said group defined by their proximity to one another, said openings of said group of perforations facing a common centre.

5. A laundry machine drum as claimed in any one of claims 1 to claim 3 wherein at least one said drum perforation is located within a dish in the drum skin extending outwardly relative to the drum spin axis.

6. A laundry machine drum as claimed in claim 4 wherein said group of drum perforations is located within a dish in the drum skin extending outwardly relative to the drum spin axis.

7. A laundry machine drum as claimed in claim 6 wherein said dish includes two said perforations opposingly oriented to one another such that the shear cuts thereof are parallel and a bridge of material is defined by said parallel cuts.

8. A laundry machine drum as claimed in claim 7 wherein said bridge of material is spaced outwardly further than the remaining material of said dish or dimple relative to said drum spin axis.

9. A laundry machine drum as claimed in claim 7 wherein said bridge of material is spaced inwardly further than the remaining material of said dish or dimple relative to said drum spin axis.

10. A laundry machine drum having a sheet material skin including an arrangement of a plurality of openings therethrough, at least one said openings having a form such that the apparent area of said opening is greater when viewed from at least one direction substantially parallel to the general plane of said drum skin in the region of said perforation than when viewed from a direction substantially perpendicular to the general plane of said drum skin in said region of said perforation.

* * * * *

UNITED STATES PATENT AND TRADEMARK OFFICE

CERTIFICATE OF CORRECTION

PATENT NO. : 6,776 015 B2 
DATED : August 17, 2003
INVENTOR(S) : Neville David Seagar and Alex David Salisbury It is certified that error appears in the above-identified patent and that said Letters Patent is hereby corrected as shown below:

Title page,
Item [56], References Cited, U.S. PATENT DOCUMENTS, please insert the following:

| | | | |
|---|---|---|---|
| -- 1,097,510 | * | 05/1914 | Bartholomew |
| 2,264,202 | | 04/40 | Forney -- |

FOREIGN PATENT DOCUMENTS, please insert the following:

| | | |
|---|---|---|
| -- WO | 9809303 | 10/89 |
| DE | 278603 | 09/14 |
| EP | 245721 | 11/87 |
| DE | 1958076 | 05/71 -- |

Column 1,
Line 36, “He” should be -- the --
Line 62, “tie” should be -- the --

Column 3, line 67 through Column 4, line 1,
“punch tool 1.” should be -- punch tool 11. --

Column 5,
Line 11, “perforation.” should be -- perforation; where said drum skin includes a plurality of dish like depressions on its inner surface, with at least one said drum perforation located within each said dish. --
Line 22, “acing” should be -- facing --

Column 6,
Line 20, delete “A laundry machine drum having” and insert -- In a laundry machine having a drum with --
Line 22, please insert after “therethrough”,
-- which drum is spun at high speed in a dehydration operation to extract wash liquids by centrifugal forces , the improvements comprising: --
Line 22, please insert after “one” -- of -- and delete “openings” and insert -- opening --
Line 26, please delete “perforation” and insert -- opening --

UNITED STATES PATENT AND TRADEMARK OFFICE

CERTIFICATE OF CORRECTION

PATENT NO. : 6,776 015 B2 
DATED : August 17, 2003
INVENTOR(S) : Neville David Seagar and Alex David Salisbury It is certified that error appears in the above-identified patent and that said Letters Patent is hereby corrected as shown below:

Column 6 (cont'd),
Line 28, please delete "perforation." and insert after "said" -- opening, such that fabric spans said openings but does not extrude through said openings during said centrifugal dehydration. --

Signed and Sealed this

Seventh Day of December, 2004

JON W. DUDAS
*Director of the United States Patent and Trademark Office*

UNITED STATES PATENT AND TRADEMARK OFFICE

CERTIFICATE OF CORRECTION

PATENT NO. : 6,776,015 B2 
DATED : August 17, 2003
INVENTOR(S) : Neville David Seagar and Alex David Salisbury It is certified that error appears in the above-identified patent and that said Letters Patent is hereby corrected as shown below:

Title page,
Item [56], References Cited, U.S. PATENT DOCUMENTS, insert the following:

| | | | |
|---|---|---|---|
| -- 1,097,510 | * | 05/1914 | Bartholomew |
| 2,264,202 | | 04/40 | Forney --. |

FOREIGN PATENT DOCUMENTS, insert the following:

| | | |
|---|---|---|
| -- WO | 9809303 | 10/89 |
| DE | 278603 | 09/14 |
| EP | 245721 | 11/87 |
| DE | 1958076 | 05/71 --. |

Column 4, line 62 through Column 6, line 28,
Delete claims 1-10 and substitute the following claims 1-22:

1. A laundry machine drum having a sheet material skin including an arrangement of a plurality of perforations therethrough, each of one or more of said perforations including:

a shear cut in said sheet material, the sheet being deformed in the region of said shear cut such that the edge of the sheet material of one side of said shear cut is offset from the edge of the sheet material of the other side of said shear cut over at least some of the length of said shear cut such that an opening is formed between said offset edges and the apparent area of said opening is greater when viewed from at least one direction substantially parallel to the general plane of said drum skin in the region of said perforation than when viewed from a direction substantially perpendicular to the general plane of said drum skin in said region of said perforation;

wherein said drum skin includes a plurality of dish like depressions on its inner surface, with at least one said drum perforation located within each said dish.

2. A laundry machine drum as claimed in claim 1 wherein said deformed sheet material the material of one said side of said shear cut is displaced outward from the material of the other side of said shear cut relative to the intended spin axis of said drum, but the planar orientation of said regions immediately adjacent the edges of said regions at said shear cut are parallel to one another.

3. A laundry machine drum as claimed in claim 2 wherein said drum includes at least one group of two or more said perforations, said group defined by their proximity to one another, said openings of said group of perforations facing a common centre.

It is certified that error appears in the above-identified patent and that said Letters Patent is hereby corrected as shown below:

Column 4, line 62 through Column 6, line 28 (cont'd),

4. A laundry machine drum as claimed in claim 1 wherein said drum includes at least one group of two or more said perforations, said group defined by their proximity to one another, said openings of said group of perforations facing a common centre.

5. A laundry machine drum as claimed in claim 4 wherein said group of drum perforations is located within a dish in the drum skin extending outwardly relative to the drum spin axis.

6. A laundry machine drum as claimed in claim 5 wherein said dish includes two said perforations opposingly oriented to one another such that the shear cuts thereof are parallel and a bridge of material is defined by said parallel cuts.

7. A laundry machine drum as claimed in claim 6 wherein said bridge of material is spaced outwardly further than the remaining material of said dish or dimple relative to said drum spin axis.

8. A laundry machine drum as claimed in claim 6 wherein said bridge of material is spaced inwardly further than the remaining material of said dish or dimple relative to said drum spin axis.

9. In a laundry machine having a drum with a sheet material skin including an arrangement of a plurality of openings therethrough, which drum is spun at high speed in a dehydration operation to extract wash liquids by centrifugal forces, the improvement comprising: at least one of said opening having a form such that the apparent area of said opening is greater when viewed from at least one direction substantially parallel to the general plane of said drum skin in the region of said opening than when viewed from a direction substantially perpendicular to the general plane of said drum skin in said region of said opening, such that fabric spans said openings but does not extrude through said openings during said centrifugal dehydration.

It is certified that error appears in the above-identified patent and that said Letters Patent is hereby corrected as shown below:

Column 4, line 62 through Column 6, line 28 (cont'd),

10. The improvement as claimed in claim 9 wherein said form of said openings is such that material surrounding said opening does not project into said drum beyond said general plane of said drum skin.

11. The improvement as claimed in claim 10 wherein said apparent area of said opening when viewed from substantially perpendicular to the general plane of said drum skin in said regions of said opening is substantially zero.

12. A laundry machine having a drum as claimed in claim 9 wherein said apparent area of said opening when viewed from substantially perpendicular to the general plane of said drum skin in said regions of said opening is substantially zero.

13. In a laundry machine having a drum for holding a laundry load, which drum is spun at high speed in a dehydration operation to extract wash liquids by centrifugal forces, the drum having a sheet material skin including an arrangement of a plurality of perforations therethrough, the improvement comprising each of one or more of said perforations including:

a shear cut in said sheet material, the sheet being deformed in the region of said shear cut such that the edge of the sheet material of one side of said shear cut is offset from the edge of the sheet material of the other side of said shear cut over at least some of the length of said shear cut such that an opening is formed between said offset edges and the apparent area of said opening is greater when viewed from at least one direction substantially parallel to the general plane of said drum skin in the region of said perforation than when viewed from a direction substantially perpendicular to the general plane of said drum skin in said region of said perforation.

14. The improvement as claimed in claim 13 wherein said drum perforation is such that during said centrifugal dehydration said fabric spans said perforation but does not extrude through said perforation.

UNITED STATES PATENT AND TRADEMARK OFFICE

CERTIFICATE OF CORRECTION

PATENT NO. : 6,776,015 B2
DATED : August 17, 2003
INVENTOR(S) : Neville David Seagar and Alex David Salisbury It is certified that error appears in the above-identified patent and that said Letters Patent is hereby corrected as shown below:

Column 4, line 62 through Column 6, line 28 (cont'd),

15. The improvement as claimed in claim 13 wherein said perforation does not project into said drum beyond said general plane of said drum skin.

16. The improvement as claimed in claim 15 wherein said deformed sheet material the material of one said side of said shear cut is displaced outward from the material of the other side of said shear cut relative to the intended spin axis of said drum, but the planar orientation of said regions immediately adjacent the edges of said regions at said shear cut are parallel to one another.

17. The improvement as claimed in claim 16 wherein said drum includes at least one group of two or more said perforations, said group defined by their proximity to one another, said openings of said group of perforations facing a common centre.

18. The improvement as claimed in claim 13 wherein said drum includes at least one group of two or more said perforations, said group defined by their proximity to one another, said openings of said group of perforations facing a common centre.

19. The improvement as claimed in claim 18 wherein said group of drum perforations is located within a dish in the drum skin extending outwardly relative to the drum spin axis.

20. The improvement as claimed in claim 19 wherein said dish includes two said perforations opposingly oriented to one another such that the shear cuts thereof are parallel and a bridge of material is defined by said parallel cuts.

21. The improvement as claimed in claim 20 wherein said bridge of material is spaced outwardly further than the remaining material of said dish or dimple relative to said drum spin axis.

UNITED STATES PATENT AND TRADEMARK OFFICE

CERTIFICATE OF CORRECTION

PATENT NO. : 6,776,015 B2 
DATED : August 17, 2003
INVENTOR(S) : Neville David Seagar and Alex David Salisbury It is certified that error appears in the above-identified patent and that said Letters Patent is hereby corrected as shown below:

Column 4, line 62 through Column 6, line 28 (cont'd),

22. The improvement as claimed in claim 20 wherein said bridge of material is spaced inwardly further than the remaining material of said dish or dimple relative to said drum spin axis.

This certificate supersedes Certificate of Correction issued December 7, 2004.

Signed and Sealed this

Sixth Day of June, 2006

JON W. DUDAS
*Director of the United States Patent and Trademark Office*

UNITED STATES PATENT AND TRADEMARK OFFICE

CERTIFICATE OF CORRECTION

PATENT NO. : 6,776,015 B2 
DATED : August 17, 2004
INVENTOR(S) : Neville David Seagar and Alex David Salisbury It is certified that error appears in the above-identified patent and that said Letters Patent is hereby corrected as shown below:

Title page,
Item [56], References Cited, U.S. PATENT DOCUMENTS, insert the following:

| | | | |
|---|---|---|---|
| -- 1,097,510 | * | 05/1914 | Bartholomew |
| 2,264,202 | | 04/40 | Forney --. |

FOREIGN PATENT DOCUMENTS, insert the following:

| | | |
|---|---|---|
| -- WO | 9809303 | 10/89 |
| DE | 278603 | 09/14 |
| EP | 245721 | 11/87 |
| DE | 1958076 | 05/71 --. |

Column 4, line 62 through Column 6, line 28,
Delete claims 1-10 and substitute the following claims 1-22:

1. A laundry machine drum having a sheet material skin including an arrangement of a plurality of perforations therethrough, each of one or more of said perforations including:

a shear cut in said sheet material, the sheet being deformed in the region of said shear cut such that the edge of the sheet material of one side of said shear cut is offset from the edge of the sheet material of the other side of said shear cut over at least some of the length of said shear cut such that an opening is formed between said offset edges and the apparent area of said opening is greater when viewed from at least one direction substantially parallel to the general plane of said drum skin in the region of said perforation than when viewed from a direction substantially perpendicular to the general plane of said drum skin in said region of said perforation;

wherein said drum skin includes a plurality of dish like depressions on its inner surface, with at least one said drum perforation located within each said dish.

2. A laundry machine drum as claimed in claim 1 wherein said deformed sheet material the material of one said side of said shear cut is displaced outward from the material of the other side of said shear cut relative to the intended spin axis of said drum, but the planar orientation of said regions immediately adjacent the edges of said regions at said shear cut are parallel to one another.

3. A laundry machine drum as claimed in claim 2 wherein said drum includes at least one group of two or more said perforations, said group defined by their proximity to one another, said openings of said group of perforations facing a common centre.

It is certified that error appears in the above-identified patent and that said Letters Patent is hereby corrected as shown below:

Column 4, line 62 through Column 6, line 28 (cont'd),

4. A laundry machine drum as claimed in claim 1 wherein said drum includes at least one group of two or more said perforations, said group defined by their proximity to one another, said openings of said group of perforations facing a common centre.

5. A laundry machine drum as claimed in claim 4 wherein said group of drum perforations is located within a dish in the drum skin extending outwardly relative to the drum spin axis.

6. A laundry machine drum as claimed in claim 5 wherein said dish includes two said perforations opposingly oriented to one another such that the shear cuts thereof are parallel and a bridge of material is defined by said parallel cuts.

7. A laundry machine drum as claimed in claim 6 wherein said bridge of material is spaced outwardly further than the remaining material of said dish or dimple relative to said drum spin axis.

8. A laundry machine drum as claimed in claim 6 wherein said bridge of material is spaced inwardly further than the remaining material of said dish or dimple relative to said drum spin axis.

9. In a laundry machine having a drum with a sheet material skin including an arrangement of a plurality of openings therethrough, which drum is spun at high speed in a dehydration operation to extract wash liquids by centrifugal forces, the improvement comprising: at least one of said opening having a form such that the apparent area of said opening is greater when viewed from at least one direction substantially parallel to the general plane of said drum skin in the region of said opening than when viewed from a direction substantially perpendicular to the general plane of said drum skin in said region of said opening, such that fabric spans said openings but does not extrude through said openings during said centrifugal dehydration.

It is certified that error appears in the above-identified patent and that said Letters Patent is hereby corrected as shown below:

Column 4, line 62 through Column 6, line 28 (cont'd),

10. The improvement as claimed in claim 9 wherein said form of said openings is such that material surrounding said opening does not project into said drum beyond said general plane of said drum skin.

11. The improvement as claimed in claim 10 wherein said apparent area of said opening when viewed from substantially perpendicular to the general plane of said drum skin in said regions of said opening is substantially zero.

12. A laundry machine having a drum as claimed in claim 9 wherein said apparent area of said opening when viewed from substantially perpendicular to the general plane of said drum skin in said regions of said opening is substantially zero.

13. In a laundry machine having a drum for holding a laundry load, which drum is spun at high speed in a dehydration operation to extract wash liquids by centrifugal forces, the drum having a sheet material skin including an arrangement of a plurality of perforations therethrough, the improvement comprising each of one or more of said perforations including:

a shear cut in said sheet material, the sheet being deformed in the region of said shear cut such that the edge of the sheet material of one side of said shear cut is offset from the edge of the sheet material of the other side of said shear cut over at least some of the length of said shear cut such that an opening is formed between said offset edges and the apparent area of said opening is greater when viewed from at least one direction substantially parallel to the general plane of said drum skin in the region of said perforation than when viewed from a direction substantially perpendicular to the general plane of said drum skin in said region of said perforation.

14. The improvement as claimed in claim 13 wherein said drum perforation is such that during said centrifugal dehydration said fabric spans said perforation but does not extrude through said perforation.

It is certified that error appears in the above-identified patent and that said Letters Patent is hereby corrected as shown below:

Column 4, line 62 through Column 6, line 28 (cont'd),

15. The improvement as claimed in claim 13 wherein said perforation does not project into said drum beyond said general plane of said drum skin.

16. The improvement as claimed in claim 15 wherein said deformed sheet material the material of one said side of said shear cut is displaced outward from the material of the other side of said shear cut relative to the intended spin axis of said drum, but the planar orientation of said regions immediately adjacent the edges of said regions at said shear cut are parallel to one another.

17. The improvement as claimed in claim 16 wherein said drum includes at least one group of two or more said perforations, said group defined by their proximity to one another, said openings of said group of perforations facing a common centre.

18. The improvement as claimed in claim 13 wherein said drum includes at least one group of two or more said perforations, said group defined by their proximity to one another, said openings of said group of perforations facing a common centre.

19. The improvement as claimed in claim 18 wherein said group of drum perforations is located within a dish in the drum skin extending outwardly relative to the drum spin axis.

20. The improvement as claimed in claim 19 wherein said dish includes two said perforations opposingly oriented to one another such that the shear cuts thereof are parallel and a bridge of material is defined by said parallel cuts.

21. The improvement as claimed in claim 20 wherein said bridge of material is spaced outwardly further than the remaining material of said dish or dimple relative to said drum spin axis.

UNITED STATES PATENT AND TRADEMARK OFFICE

CERTIFICATE OF CORRECTION

PATENT NO. : 6,776,015 B2 
DATED : August 17, 2004
INVENTOR(S) : Neville David Seagar and Alex David Salisbury It is certified that error appears in the above-identified patent and that said Letters Patent is hereby corrected as shown below:

Column 4, line 62 through Column 6, line 28 (cont'd),

22. The improvement as claimed in claim 20 wherein said bridge of material is spaced inwardly further than the remaining material of said dish or dimple relative to said drum spin axis.

This certificate supersedes Certificates of Correction issued December 7, 2004 and June 6, 2006.

Signed and Sealed this

First Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,776,015 B2 
APPLICATION NO. : 09/904287
DATED : August 17, 2004
INVENTOR(S) : Neville David Seagar and Alex David Salisbury It is certified that error appears in the above-identified patent and that said Letters Patent is hereby corrected as shown below:

Title page,
Item [56], References Cited, U.S. PATENT DOCUMENTS, insert the following:

| | | | |
|---|---|---|---|
| -- 1,097,510 | * | 05/1914 | Bartholomew |
| 2,264,202 | | 04/40 | Forney --. |

FOREIGN PATENT DOCUMENTS, insert the following:

| | | |
|---|---|---|
| -- WO | 9809303 | 10/89 |
| DE | 278603 | 09/14 |
| EP | 245721 | 11/87 |
| DE | 1958076 | 05/71 --. |

Column 1,
Line 36, "He" should be -- the --.
Line 62, "tie" should be -- the --.

Column 3, line 67 through Column 4, line 1,
"punch tool." should be -- punch tool 11 --.

Column 4, line 62 through Column 6, line 28,
Delete claims 1-10 and substitute the following claims 1-22:

1. A laundry machine drum having a sheet material skin including an arrangement of a plurality of perforations therethrough, each of one or more of said perforations including:

a shear cut in said sheet material, the sheet being deformed in the region of said shear cut such that the edge of the sheet material of one side of said shear cut is offset from the edge of the sheet material of the other side of said shear cut over at least some of the length of said shear cut such that an opening is formed between said offset edges and the apparent area of said opening is greater when viewed from at least one direction substantially parallel to the general plane of said drum skin in the region of said perforation than when viewed from a direction substantially perpendicular to the general plane of said drum skin in said region of said perforation;

wherein said drum skin includes a plurality of dish like depressions on its inner surface, with at least one said drum perforation located within each said dish.

UNITED STATES PATENT AND TRADEMARK OFFICE

CERTIFICATE OF CORRECTION

PATENT NO. : 6,776,015 B2
APPLICATION NO. : 09/904287
DATED : August 17, 2004
INVENTOR(S) : Neville David Seagar and Alex David Salisbury It is certified that error appears in the above-identified patent and that said Letters Patent is hereby corrected as shown below:

Column 4, line 62 through Column 6, line 28 (cont'd),

2. A laundry machine drum as claimed in claim 1 wherein said deformed sheet material the material of one said side of said shear cut is displaced outward from the material of the other side of said shear cut relative to the intended spin axis of said drum, but the planar orientation of said regions immediately adjacent the edges of said regions at said shear cut are parallel to one another.

3. A laundry machine drum as claimed in claim 2 wherein said drum includes at least one group of two or more said perforations, said group defined by their proximity to one another, said openings of said group of perforations facing a common centre.

4. A laundry machine drum as claimed in claim 1 wherein said drum includes at least one group of two or more said perforations, said group defined by their proximity to one another, said openings of said group of perforations facing a common centre.

5. A laundry machine drum as claimed in claim 4 wherein said group of drum perforations is located within a dish in the drum skin extending outwardly relative to the drum spin axis.

6. A laundry machine drum as claimed in claim 5 wherein said dish includes two said perforations opposingly oriented to one another such that the shear cuts thereof are parallel and a bridge of material is defined by said parallel cuts.

7. A laundry machine drum as claimed in claim 6 wherein said bridge of material is spaced outwardly further than the remaining material of said dish or dimple relative to said drum spin axis.

8. A laundry machine drum as claimed in claim 6 wherein said bridge of material is spaced inwardly further than the remaining material of said dish or dimple relative to said drum spin axis.

It is certified that error appears in the above-identified patent and that said Letters Patent is hereby corrected as shown below:

Column 4, line 62 through Column 6, line 28 (cont'd),

9. In a laundry machine having a drum with a sheet material skin including an arrangement of a plurality of openings therethrough, which drum is spun at high speed in a dehydration operation to extract wash liquids by centrifugal forces, the improvement comprising: at least one of said opening having a form such that the apparent area of said opening is greater when viewed from at least one direction substantially parallel to the general plane of said drum skin in the region of said opening than when viewed from a direction substantially perpendicular to the general plane of said drum skin in said region of said opening, such that fabric spans said openings but does not extrude through said openings during said centrifugal dehydration.

10. The improvement as claimed in claim 9 wherein said form of said openings is such that material surrounding said opening does not project into said drum beyond said general plane of said drum skin.

11. The improvement as claimed in claim 10 wherein said apparent area of said opening when viewed from substantially perpendicular to the general plane of said drum skin in said regions of said opening is substantially zero.

12. A laundry machine having a drum as claimed in claim 9 wherein said apparent area of said opening when viewed from substantially perpendicular to the general plane of said drum skin in said regions of said opening is substantially zero.

13. In a laundry machine having a drum for holding a laundry load, which drum is spun at high speed in a dehydration operation to extract wash liquids by centrifugal forces, the drum having a sheet material skin including an arrangement of a plurality of perforations therethrough, the improvement comprising each of one or more of said perforations including:

UNITED STATES PATENT AND TRADEMARK OFFICE

CERTIFICATE OF CORRECTION

PATENT NO. : 6,776,015 B2
APPLICATION NO. : 09/904287
DATED : August 17, 2004
INVENTOR(S) : Neville David Seagar and Alex David Salisbury It is certified that error appears in the above-identified patent and that said Letters Patent is hereby corrected as shown below:

Column 4, line 62 through Column 6, line 28 (cont'd), a shear cut in said sheet material, the sheet being deformed in the region of said shear cut such that the edge of the sheet material of one side of said shear cut is offset from the edge of the sheet material of the other side of said shear cut over at least some of the length of said shear cut such that an opening is formed between said offset edges and the apparent area of said opening is greater when viewed from at least one direction substantially parallel to the general plane of said drum skin in the region of said perforation than when viewed from a direction substantially perpendicular to the general plane of said drum skin in said region of said perforation.

14. The improvement as claimed in claim 13 wherein said drum perforation is such that during said centrifugal dehydration said fabric spans said perforation but does not extrude through said perforation.

15. The improvement as claimed in claim 13 wherein said perforation does not project into said drum beyond said general plane of said drum skin.

16. The improvement as claimed in claim 15 wherein said deformed sheet material the material of one said side of said shear cut is displaced outward from the material of the other side of said shear cut relative to the intended spin axis of said drum, but the planar orientation of said regions immediately adjacent the edges of said regions at said shear cut are parallel to one another.

17. The improvement as claimed in claim 16 wherein said drum includes at least one group of two or more said perforations, said group defined by their proximity to one another, said openings of said group of perforations facing a common centre.

18. The improvement as claimed in claim 13 wherein said drum includes at least one group of two or more said perforations, said group defined by their proximity to one another, said openings of said group of perforations facing a common centre.

UNITED STATES PATENT AND TRADEMARK OFFICE

CERTIFICATE OF CORRECTION

PATENT NO. : 6,776,015 B2 
APPLICATION NO. : 09/904287
DATED : August 17, 2004
INVENTOR(S) : Neville David Seagar and Alex David Salisbury It is certified that error appears in the above-identified patent and that said Letters Patent is hereby corrected as shown below:

Column 4, line 62 through Column 6, line 28 (cont'd),

19. The improvement as claimed in claim 18wherein said group of drum perforations is located within a dish in the drum skin extending outwardly relative to the drum spin axis.

20. The improvement as claimed in claim 19wherein said dish includes two said perforations opposingly oriented to one another such that the shear cuts thereof are parallel and a bridge of material is defined by said parallel cuts.

21. The improvement as claimed in claim 20 wherein said bridge of material is spaced outwardly further than the remaining material of said dish or dimple relative to said drum spin axis.

22. The improvement as claimed in claim 20 wherein said bridge of material is spaced inwardly further than the remaining material of said dish or dimple relative to said drum spin axis.

This certificate supersedes Certificates of Correction issued December 7, 2004 and June 6, 2006

Signed and Sealed this

Twenty-fourth Day of October, 2006

JON W. DUDAS
*Director of the United States Patent and Trademark Office*

UNITED STATES PATENT AND TRADEMARK OFFICE

CERTIFICATE OF CORRECTION

PATENT NO. : 6,776,015 B2 
APPLICATION NO. : 09/904287
DATED : August 17, 2004
INVENTOR(S) : Neville David Seagar and Alex David Salisbury It is certified that error appears in the above-identified patent and that said Letters Patent is hereby corrected as shown below:

Title page,
Item [56], References Cited, U.S. PATENT DOCUMENTS, insert the following:

| | | | |
|---|---|---|---|
| -- 1,097,510 | * | 05/1914 | Bartholomew |
| 2,264,202 | | 04/40 | Forney --. |

FOREIGN PATENT DOCUMENTS, insert the following:

| | | |
|---|---|---|
| -- WO | 9809303 | 10/89 |
| DE | 278603 | 09/14 |
| EP | 245721 | 11/87 |
| DE | 1958076 | 05/71 --. |

Column 1,
Line 36, "He" should be -- the --.
Line 62, "tie" should be -- the --.

Column 3, line 67 through Column 4, line 1,
"punch tool." should be -- punch tool 11 --.

Column 4, line 62 through Column 6, line 28,
Delete claims 1-10 and substitute the following claims 1-23:

1. A laundry machine drum having a sheet material skin including an arrangement of a plurality of perforations therethrough, each of one or more of said perforations including:

a shear cut in said sheet material, the sheet being deformed in the region of said shear cut such that the edge of the sheet material of one side of said shear cut is offset from the edge of the sheet material of the other side of said shear cut over at least some of the length of said shear cut such that an opening is formed between said offset edges and the apparent area of said opening is greater when viewed from at least one direction substantially parallel to the general plane of said drum skin in the region of said perforation than when viewed from a direction substantially perpendicular to the general plane of said drum skin in said region of said perforation;

wherein said drum skin includes a plurality of dish like depressions on its inner surface, with at least one said drum perforation located within each said dish.

UNITED STATES PATENT AND TRADEMARK OFFICE

CERTIFICATE OF CORRECTION

PATENT NO. : 6,776,015 B2
APPLICATION NO. : 09/904287
DATED : August 17, 2004
INVENTOR(S) : Neville David Seagar and Alex David Salisbury It is certified that error appears in the above-identified patent and that said Letters Patent is hereby corrected as shown below:

Column 4, line 62 through Column 6, line 28 (cont'd),

2. A laundry machine drum as claimed in claim 1 wherein said deformed sheet material the material of one said side of said shear cut is displaced outward from the material of the other side of said shear cut relative to the intended spin axis of said drum, but the planar orientation of said regions immediately adjacent the edges of said regions at said shear cut are parallel to one another.

3. A laundry machine drum as claimed in claim 2 wherein said drum includes at least one group of two or more said perforations, said group defined by their proximity to one another, said openings of said group of perforations facing a common centre.

4. A laundry machine drum as claimed in claim 1 wherein said drum includes at least one group of two or more said perforations, said group defined by their proximity to one another, said openings of said group of perforations facing a common centre.

5. A laundry machine drum as claimed in claim 4 wherein said group of drum perforations is located within a dish in the drum skin extending outwardly relative to the drum spin axis.

6. A laundry machine drum as claimed in claim 5 wherein said dish includes two said perforations opposingly oriented to one another such that the shear cuts thereof are parallel and a bridge of material is defined by said parallel cuts.

7. A laundry machine drum as claimed in claim 6 wherein said bridge of material is spaced outwardly further than the remaining material of said dish or dimple relative to said drum spin axis.

8. A laundry machine drum as claimed in claim 6 wherein said bridge of material is spaced inwardly further than the remaining material of said dish or dimple relative to said drum spin axis.

It is certified that error appears in the above-identified patent and that said Letters Patent is hereby corrected as shown below:

Column 4, line 62 through Column 6, line 28 (cont'd),

9. In a laundry machine having a drum with a sheet material skin including an arrangement of a plurality of openings therethrough, which drum is spun at high speed in a dehydration operation to extract wash liquids by centrifugal forces, the improvement comprising: at least one of said opening having a form such that the apparent area of said opening is greater when viewed from at least one direction substantially parallel to the general plane of said drum skin in the region of said opening than when viewed from a direction substantially perpendicular to the general plane of said drum skin in said region of said opening, such that fabric spans said openings but does not extrude through said openings during said centrifugal dehydration.

10. The improvement as claimed in claim 9 wherein said form of said openings is such that material surrounding said opening does not project into said drum beyond said general plane of said drum skin.

11. The improvement as claimed in claim 10 wherein said apparent area of said opening when viewed from substantially perpendicular to the general plane of said drum skin in said regions of said opening is substantially zero.

12. A laundry machine having a drum as claimed in claim 9 wherein said apparent area of said opening when viewed from substantially perpendicular to the general plane of said drum skin in said regions of said opening is substantially zero.

13. In a laundry machine having a drum for holding a laundry load, which drum is spun at high speed in a dehydration operation to extract wash liquids by centrifugal forces, the drum having a sheet material skin including an arrangement of a plurality of perforations therethrough, the improvement comprising each of one or more of said perforations including:

UNITED STATES PATENT AND TRADEMARK OFFICE

CERTIFICATE OF CORRECTION

PATENT NO. : 6,776,015 B2
APPLICATION NO. : 09/904287
DATED : August 17, 2004
INVENTOR(S) : Neville David Seagar and Alex David Salisbury It is certified that error appears in the above-identified patent and that said Letters Patent is hereby corrected as shown below:

Column 4, line 62 through Column 6, line 28 (cont'd), a shear cut in said sheet material, the sheet being deformed in the region of said shear cut such that the edge of the sheet material of one side of said shear cut is offset from the edge of the sheet material of the other side of said shear cut over at least some of the length of said shear cut such that an opening is formed between said offset edges and the apparent area of said opening is greater when viewed from at least one direction substantially parallel to the general plane of said drum skin in the region of said perforation than when viewed from a direction substantially perpendicular to the general plane of said drum skin in said region of said perforation.

14. The improvement as claimed in claim 13 wherein said drum perforation is such that during said centrifugal dehydration said fabric spans said perforation but does not extrude through said perforation.

15. The improvement as claimed in claim 13 wherein said perforation does not project into said drum beyond said general plane of said drum skin.

16. The improvement as claimed in claim 15 wherein said deformed sheet material the material of one said side of said shear cut is displaced outward from the material of the other side of said shear cut relative to the intended spin axis of said drum, but the planar orientation of said regions immediately adjacent the edges of said regions at said shear cut are parallel to one another.

17. The improvement as claimed in claim 16 wherein said drum includes at least one group of two or more said perforations, said group defined by their proximity to one another, said openings of said group of perforations facing a common centre.

18. The improvement as claimed in claim 13 wherein said drum includes at least one group of two or more said perforations, said group defined by their proximity to one another, said openings of said group of perforations facing a common centre.

UNITED STATES PATENT AND TRADEMARK OFFICE

CERTIFICATE OF CORRECTION

PATENT NO. : 6,776,015 B2 
APPLICATION NO. : 09/904287
DATED : August 17, 2004
INVENTOR(S) : Neville David Seagar and Alex David Salisbury It is certified that error appears in the above-identified patent and that said Letters Patent is hereby corrected as shown below:

Column 4, line 62 through Column 6, line 28 (cont'd),

19. The improvement as claimed in claim 18 wherein said group of drum perforations is located within a dish in the drum skin extending outwardly relative to the drum spin axis.

20. The improvement as claimed in claim 19 wherein said dish includes two said perforations opposingly oriented to one another such that the shear cuts thereof are parallel and a bridge of material is defined by said parallel cuts.

21. The improvement as claimed in claim 20 wherein said bridge of material is spaced outwardly further than the remaining material of said dish or dimple relative to said drum spin axis.

22. The improvement as claimed in claim 20 wherein said bridge of material is spaced inwardly further than the remaining material of said dish or dimple relative to said drum spin axis.

23. The improvement as claimed in claim 13 wherein said drum skin includes a plurality of dish-like depressions on its inner surface, with at least one said drum perforation located within each said dish.

This certificate supersedes Certificates of Correction issued December 7, 2004, June 6, 2006, and October 24, 2006.

Signed and Sealed this

Ninth Day of January, 2007

JON W. DUDAS
*Director of the United States Patent and Trademark Office*